US005340413A

United States Patent [19]

Martis

[11] Patent Number: 5,340,413

[45] Date of Patent: Aug. 23, 1994

[54] FE-NI BASED SOFT MAGNETIC ALLOYS HAVING NANOCRYSTALLINE STRUCTURE

[75] Inventor: Ronald Martis, East Hanover, N.J.

[73] Assignee: AlliedSignal Inc., Morristown, N.J.

[21] Appl. No.: 896,505

[22] Filed: Jun. 2, 1992

Related U.S. Application Data

[63] Continuation of Ser. No. 665,396, Mar. 6, 1991, abandoned.

[51] Int. Cl.[5] ..... H01F 1/04

[52] U.S. Cl. ..... 148/305; 148/310; 148/312; 420/43; 420/50; 420/51; 420/52; 420/53; 420/54; 420/452; 420/453; 420/459; 420/581; 420/584.1

[58] Field of Search ..... 148/305, 310, 312; 420/43, 50, 51, 52, 53, 54, 452, 453, 459, 581, 584.1

[56] References Cited

U.S. PATENT DOCUMENTS

| | | | |
|---|---|---|---|
| 4,221,257 | 10/1978 | Narasimhan | 164/87 |
| 4,881,989 | 10/1987 | Yoshizawa | 148/302 |
| 4,985,089 | 7/1988 | Yoshizawa | 148/303 |

FOREIGN PATENT DOCUMENTS

| | | |
|---|---|---|
| 0049770 | 4/1982 | European Pat. Off. . |
| 9003652 | 4/1990 | European Pat. Off. . |
| 3021224 | 12/1990 | Fed. Rep. of Germany . |

OTHER PUBLICATIONS

Patent Abstracts of Japan, vol. 7, No. 52, Mar. 2, 1983 & JP, A 57202709.

Journal of Applied Physics, vol. 52, No. 3, Part II, Mar. 1981, pp. 1889–1891.

Journal of Materials Science Letters, vol. 9, No. 9, Sep. 1990, pp. 1112–1114.

Magnetic Properties of Glassy (FE-Ni) 86 B14 Alloys Journal De Physique Colloque C8 Supplement AU N08, Tome 41 Aout 1980 pp. C8-701-703 R. Hasegawa.

Effect of Comp. in (Fe,Ni,Cr) (P,B) and (Fe,Ni,Mo)B Metallic Glasses Journal De Physique Colloque C8 Supplement au n08, Tome 41 aout 1980 pp. C8-13-1-134.

Effect of Thermal Treatments Beyond Tg on Crystallization, Kinetics in Metallic Glasses, C. Antonione et al. Conf. on Metallic glasses: Science & Technology Budapest 1980 vol. 2, pp. 151–156.

Tem Studies of Kinetics of Crystallization of Three Fe-Ni Based Alloys Proc. for Conf. on Metallic Glasses, Science & Technology, S. Ranganathan et al. Budapest 1980, vol. 2 pp. 327–333.

Thermal Stability and Crystallization of Transition Metal-Boron Metalic Glasses, Proc. for Conf. on Metallic Glasses, Science & Technology, R. Kemeny et al., Budapest, 1980 vol. 2 pp. 231–238.

*Primary Examiner*—John P. Sheehan

*Attorney, Agent, or Firm*—Ernest D. Buff; Roger H. Criss

[57] ABSTRACT

Fe-Ni based soft magnetic alloys having nanocrystalline particles substantially uniformly distributed throughout an amorphous matrix are disclosed. The soft magnetic alloys of the present invention may be represented by the general formula:

$$(Fe_{1-x}Ni_x)_aM_b(B_{1-y}Si_y)_c$$

where M is a metal chosen from the group consisting of Mo, Cr, Hf, Nb, Ta, Ti, V, W, Zr. The quantity "x" is between about 0.2 and about 0.9; a is between about 60 and 90; b is between about 0.1 and 10; y is between 0 and 0.5; and c is between about 0.1 and about 30, with the stipulation that all the elements, plus impurities, add up to 100. Also described is a process for making the nanocrystalline alloys and for optimizing certain magnetic properties of said alloys via a two step anneal.

11 Claims, 9 Drawing Sheets

FE-NI BASED SOFT MAGNETIC ALLOYS HAVING NANOCRYSTALLINE STRUCTURE

This application is a continuation of U.S. patent application Ser. No. 665,396 filed Mar. 6, 1991 now abandoned.

BACKGROUND OF THE INVENTION

1. Field of the Invention.

The invention of the present application relates to Fe-Ni based alloys having improved soft magnetic properties and containing nanocrystalline particles. The Fe-Ni based alloys of the present invention may be tailored to specific applications by varying the annealing conditions. The formation of the nanocrystalline phase is achieved without the addition of copper.

2. Description of the Prior Art

Materials exhibiting good soft magnetic properties (ferromagnetic properties) include certain crystalline alloys (such as Permalloys), certain amorphous metallic alloys (such as cobalt or iron based alloys) and more recently, certain alloys containing nanocrystalline particles. Each of the three types of alloys has particular advantages and disadvantages associated with their production, use and characteristics.

Since metallic glasses were first formed, researchers have been looking for new compositions which possess improved soft magnetic properties, such as low magnetostriction, low core loss, and high saturation induction in combination with thermal stability, and cost efficient production. Metallic glasses containing cobalt have the best magnetic properties, but are expensive. Fe and Fe-Ni based soft magnetic alloys are much cheaper to produce because the components are cheaper, but display slightly less desirable magnetic properties. Thus, much research has centered around developing an Fe or Fe-Ni based soft magnetic alloy with improved magnetic characteristics.

Amorphous metallic metals are produced from alloys, and cooled at a very fast rate so that no crystalline structure forms. The rapid cooling prevents the formation of long range order within the metal, and gives the resulting metal its amorphous structure. The lack of long range order and defects such as grain boundaries gives the resulting amorphous metal good soft magnetic properties such as good dc properties and low core loss as well as good ductility.

Permalloys, Ni-based alloys, are cast into ingots. The ingots are then rolled into sheets, which can be worked into the desired shape. Permalloys display crystalline structure throughout the composition, and show low saturation induction and small magnetostrictions, but lose their soft magnetic properties when subjected to plastic deformation.

U.S. Pat. No. 4,881,989 discloses soft magnetic materials formed from Fe-Co or Fe-Ni base alloys containing 0.1 to 3.0 atomic percent Cu, and 0.1–30 atomic percent of at least one element from the group Nb, W, Ta, Zr, Hf, Ti and Mo, and containing crystallites with an average particle size of 100 nm or less. The Fe-Ni and Fe-Co based soft magnetic alloys disclosed in U.S. Pat. No. 4,881,989 exhibit good magnetic properties, but require the addition of copper which is not soluble in Fe in order to provide nucleation sites for the formation of nanocrystallites.

U.S. Pat. No. 4,985,089 discloses Fe-Ni and Fe-Co based soft magnetic alloy powders having 0.1 to 3 atomic % Cu, 0.1 to 30 atomic % of an element chosen from Nb, W, Ta, Zr, Hf, Ti, and Mo; 0 to 10 atomic % of an element chosen from V, Cr, Mn, A1, elements in the platinum group, Sc, Y, rare earth elements, Au, Zn, Sn, and Re; and 0 to 10 atomic % of an element chosen from C, Ge, P, Ga, Sb, In, Be, and As. The alloys have fine crystalline particles with an average particle size of 500 A or less, a bcc Fe-based crystal structure and require the addition of Cu.

Studies on the formation of crystallites in Fe and Fe-Ni based alloy compositions without the addition of Cu have been previously reported. For example, *Magnetic Properties of Glassy (Fe–Ni)$_{86}$B$_{14}$Alloys*, R. Hasegawa, Journal De Physique, Colloque C8, supplement 8, Tome 41, pages 701–704, 1980 reports dual crystallization events having separate crystallization and Curie temperatures for several (Fe-Ni)$_{86}$B$_{14}$ alloys.

Dual crystallization events for $Fe_{43-84}Ni_{0-41}Mo_{2-8.5}B_{10-15}$ are reported in *Effect of Composition in (Fe, Ni, Cr,) (P, B) and (Fe, Ni, Mo)B Metallic Glasses*, Antonione, Battezzati, Lucci, Riontino, Tabasso, Venturello, Journal De Physique, Colloque 8, supplement 8, Tome 41, pages 131–134, 1980.

Studies of the kinetics of the crystallization temperatures of $Fe_{40}Ni_{38}Mo_4B_{18}$ are reported in *Effect of Thermal Treatments Beyond $T_g$ on Crystallization Kinetics in Metallic Glasses*, Antonione, Battezzati, Lucci, Riontino, Tabasso, Venturello, Proceedings of the Conference on Metallic Glasses: Science & Technology, vol. 2, pages 151–156, 1980.

*TEM Studies of Kinetics of Crystallization of Three Fe-Ni Based Alloys*, Ranganathan, Claus, Tiwari and Heimendahl, Proceedings of the Conference on Metallic Glasses, Science & Technology, Budapest 1980, vol. 2, pgs 327–333, discusses the kinetics of crystallization of three Fe-Ni based compositions.

*Thermal Stability and Crystallization of Transition Metal-*Boron Metallic Glasses, Kemeny, Vincze, Balogh, Granasy, Fogarassy, Hajdu, Svab, Proceedings of the Conference on Metallic Glasses, Science & Technology, Budapest 1980, vol. 2, pg 231–238, discusses the structure of the crystalline phases of (Fe-Ni)B and (Fe-Co)B amorphous alloys.

However, these studies concentrated on the kinetics of crystallization, and wholly failed to recognize or consider the soft magnetic properties of the resulting alloys, which can be achieved via post casting treatment of the alloy, or a process capable of optimizing said soft magnetic properties.

Further, the cited patents require the copper to seed nanocrystalline growth, and report a nanocrystalline phase with a bcc crystalline structure.

SUMMARY OF THE INVENTION

The invention relates to magnetic materials formed from Fe-Ni based alloys and having nanocrystalline particles dispersed throughout an amorphous metal matrix. The alloys of the present invention display soft magnetic properties similar to Permalloys, but are prepared by rapidly solidifying an Fe-Ni based alloy to form an amorphous metallic material and subsequently annealing the amorphous metallic material. The alloys of the present invention display at least two crystallization temperatures. The first crystallization temperature corresponds to the formation of the nanocrystalline particles, and the second corresponds to the formation of a second crystalline phase(s).

The present invention is also directed to a class of magnetic materials which display especially good soft magnetic properties when subjected to either a transverse or a longitudinal magnetic field.

The present invention is further directed to magnetic materials consisting of an amorphous metallic matrix having nanocrystalline particles which are essentially uniformly distributed throughout the matrix and are formed from alloys which are essentially free of Cu. The nanocrystallites have an average particle size of not greater than 100 nm, and preferably not exceeding 30 nm.

The present invention is additionally directed to a process for producing such materials which comprises the steps of rapidly solidifying an Fe-Ni based alloy to form an amorphous metallic alloy, and annealing the alloy. The amorphous metallic alloy is annealed preferably between the first and second crystallization temperatures to form a nanocrystalline phase in an amorphous matrix. To optimize magnetic properties, the alloy is preferably allowed to cool to, and held at a second annealing temperature which is just below either the Curie temperature of the second magnetic phase (believed to correspond to the amorphous phase), or the Curie temperature of the nanocrystalline phase. Imposition of a magnetic field during the anneal imparts further improved field specific magnetic properties to the alloy containing nanocrystallites.

DETAILED DESCRIPTION OF THE INVENTION

Figure 1:
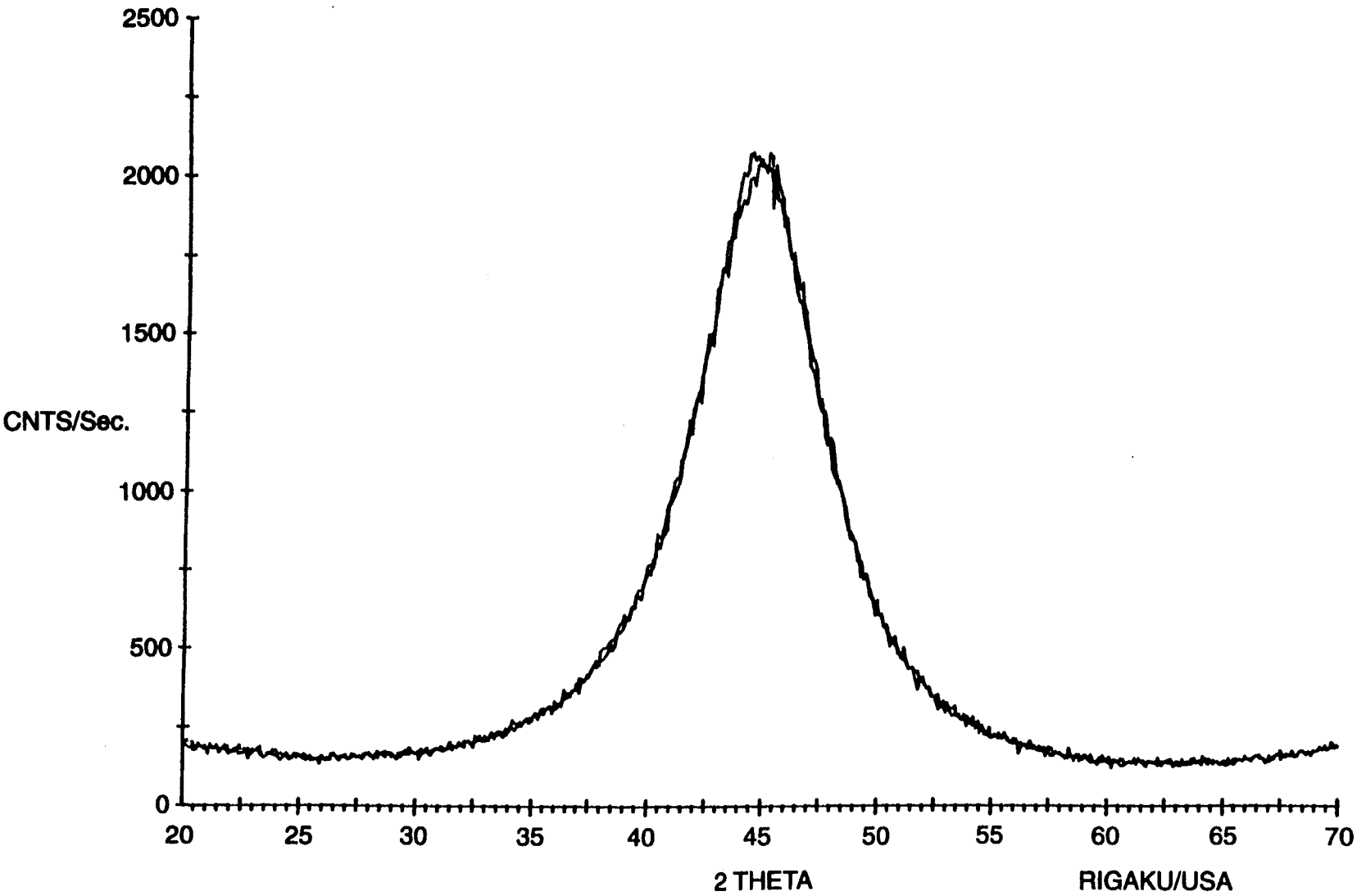
FIG. 1 is an X-ray diffraction pattern of an as-cast alloy.

The alloys utilized in the production of the magnetic materials of the present invention are represented by the general formula:

$$(Fe_{1-x}Ni_x)_aM_b(B_{1-y}Si_y)_c$$

ps where "a" through "c" are atomic percent, and the sum of "a" through "c" plus impurities is essentially 100. The quantity "x" ranges from about 0.2 to about 0.9, and preferably is between about 0.48 and about 0.9. The atomic percentage of Fe-Ni represented by "a" is between about 60 and about 90, preferably between about 70 and about 87 atomic percent. When the amount of Fe and Ni is increased above about 90 atomic percent, or decreased below about 60 atomic percent, the alloy becomes difficult to cast via melt quenching techniques, and the resulting metallic materials tend to exhibit inadequate soft magnetic properties. More particularly, below about 60 atomic % Fe and Ni there is too much metalloid present to produce a good soft magnetic material.

M is at least one metal selected from the group consisting of Mo, Cr, Hf, Nb, Ta, Ti, V, W, and Zr. M is preferably selected from the group Cr, Ta and Mo, and is most preferably Mo. The percent of M, represented by "b" in the above composition, is between about 0.1 to about 10 atomic % with about 1.0 to about 8.0 being preferred, and about 2.0 to about 4.0 atomic % being most preferred. As the atomic percentage decreases below about 2.0 atomic %, the nanocrystalline particles become more difficult to form during useful annealing conditions of the type described hereinafter. Alloys with more than 10 atomic % M are also difficult to cast via melt quenching techniques.

The percentage of metalloid (B and Si), which is represented by "c", is between about 0.1 to about 30 atomic percent, with about 13 to about 30 atomic % being the preferred range. In particular, the atomic percentage of boron is between about 0.1 to about 30 atomic %, with about 13 to about 22 atomic % being the preferred range, and about 14 to about 18 atomic % being most preferred. As the atomic percentage of B is increased above the preferred about 22 atomic %, the volume percentage of boride tends to increase, thereby decreasing the volume percentage of the nanocrystalline phase, and correspondingly degrading the magnetic properties of the alloy. Further, amounts of boron in excess of about 22 atomic % tie up Fe and Ni in the amorphous phase, thus decreasing the amount of nanocrystalline particles which can form.

Within certain ranges Si facilitates formation of the crystallites by increasing the temperature difference between the first crystallization temperature, $T_{x1}$ and the second crystallization temperature $T_{x2}$. Si also aids in forming the amorphous metallic material, which is a precursor to the nanocrystalline alloy of the present invention. The range of Si (represented by "y" in the above composition) is from 0 up to about 0.5. Thus, Si ranges from 0 up to about 15 atomic %. Preferably Si, if present, is present in an amount up to about 10 atomic %, and most preferably in an amount up to about 5 atomic %.

The components are melted in the desired ratio and then cast, for example, by the planar flow casting technique disclosed in U.S. Pat. No. 4,221,257, incorporated herein by reference, to produce strips of amorphous metallic material.

Nanocrystalline particles are formed in the amorphous metallic material subsequent to casting in the first step of, a most preferably, two step annealing process. The resulting alloy preferably has nanocrystalline particles essentially uniformly distributed throughout the alloy which account for no less than about 20% of the alloy structure by volume. The remaining portion of the alloy is an amorphous phase.

In the first step the amorphous material is annealed at a temperature below the onset of the second crystallization temperature. Any temperature below the onset of the second crystallization temperature may be used; however, the lower the temperature, the longer the annealing time at that temperature. Accordingly, the temperature for the first step of the anneal is preferably between the onset of the first crystallization temperature and the temperature which is the midpoint between the onsets of the first and second crystallization temperatures. Further, severe annealing conditions (excessive temperature, time or a combination thereof) result in the formation of a second crystalline phase, which degrades the overall soft magnetic properties of the resulting product. Accordingly, the alloy is preferably annealed at a temperature between the onset of the first crystallization temperature and the onset of the second crystallization temperature for between about one half to about two hours. The anneal is most preferably carried out in an inert atmosphere, such as nitrogen.

For the family of alloys wherein M is Mo, the nanocrystalline particles formed during the first step of the anneal exhibit essentially fcc crystal structure, and are made up essentially of NiFeMo crystals. These nanocrystalline particles are generally Ni-based and should not be allowed to grow to an effective particle size larger than about 100 nm, and preferably not larger than approximately 30 nm. Nanocrystalline particles with effective particle sizes of 10 nm or less are the most preferred. For alloys containing Mo, annealing at temperatures at or above the second crystallization temperature causes the formation of the second crystalline phase, which is boride based, and degrades the overall soft magnetic properties of the resulting product.

After the first step of the anneal, the nanocrystalline alloy is cooled to the second annealing temperature in about one half hour. The second step of the anneal may be carried out within 50° C. of, and preferably just below, the Curie temperature of either the second magnetic phase, or the nanocrystalline phase. In either case, the second step of the anneal is most preferably carried out under an inert atmosphere (such as N2). The alloy may be annealed for up to about 2 hours, and is preferably annealed for about one hour. In no event should the temperature of the second step of the anneal exceed the onset of the second crystallization event of the precursor amorphous alloy, because undesirable, secondary crystals will be formed.

The anneal may be, and preferably is, conducted under the influence of either a longitudinal or a transverse field in order to obtain specific desirable magnetic characteristics. A transverse field is one which is applied along the width of the material, or the height of a toroidal core (when in a core form). A longitudinal field is one which is applied along the length of the strips or around the circumference of a toroidal core (when in such a form). A longitudinal field is applied by passing an ac current through wire windings which are wound around a strip or a toroidal core.

The field does not affect the properties of the alloy during the first step, as the annealing temperature is generally above the Curie temperatures. However, as stated above, the second step of the anneal is conducted below the Curie temperature of either the nanocrystalline or the second magnetic phase. Thus, imposition of a magnetic field during the second step of the anneal creates an alloy with improved soft magnetic properties in the field direction.

As stated above, the anneal may be carried out in a transverse, longitudinal or no magnetic field, but alloys annealed under the influence of a magnetic field display particularly good magnetic properties for applications in the direction of the externally applied annealing field. For longitudinal applications, the field strength is preferably greater than 80 A/m (1 Oe), and most preferably 800 A/m (10 Oe). Transverse field may be applied using either permanent magnets or a solenoid. Particularly low core losses may be achieved by applying a large transverse field (approximately 80 kA/m) during the anneal.

Alloys of the present invention annealed under the influence of a transverse field display especially improved magnetic properties for certain applications, while alloys annealed under the influence of a longitudinal field are particularly suited for others.

To minimize core loss, the second step annealing temperature is preferably below the Curie temperature of the nanocrystalline phase. These alloys display core losses and dc coercivities in the range typical of Permalloys. The soft magnetic properties, particularly the core loss displayed by these alloys are lowest when annealed under the influence of a transverse field, and thus have particular utility in choke coils, electromagnetic interference filters, current and pulse transformers.

Alternatively, to maximize the squareness ratio (as defined in Table 6), the second step of the anneal is conducted just under the (lower) Curie temperature of the second magnetic phase and under the influence of a longitudinal field. The rest of the annealing conditions are identical to those when the second anneal is conducted just below the Curie temperature of the nanocrystalline phase. These alloys display good squareness, but increased core loss. Thus, the, alloys of this embodiment have particular utility in magnetic amplifiers, and various types of sensors.

Because the alloys of the present application are cast and then annealed, the alloy may be worked in the as-cast state in order to take advantage of generally better ductility.

The following examples are meant to be illustrative, and not enumerative. Various changes may suggest themselves to one skilled in the art. The true spirit and scope of the present invention should be determined by reference to the appended claims, and should not be limited by the following examples.

EXAMPLE 1

An alloy with the composition $Fe_{40}Ni_{38}Mo_4B_{18}$ was melted, and expelled through a slotted nozzle and onto the peripheral surface of chill roll (a rotating copper alloy disk having a 15 inch diameter, and a 5 inch width). The chill roll was rotated at about 1000 rpm, which corresponds to a linear velocity at the peripheral surface of about 1220 meters per minute. The resulting ribbon was ½ inch wide, 1.1 mil thick, and essentially amorphous. The resulting amorphous alloy displayed two onset of crystallization temperatures, $T_{x1}$ at 439° C. and $T_{x2}$ at 524° C. The ribbon was wound into toroidal cores having a mass of 10 g, an inner diameter of 4.06 cm, and an outer diameter of 4.26 cm.

EXAMPLE 2

Cores made according to Example 1 were single step annealed according to the conditions listed below.

TABLE 1

| SAMPLE | ANNEALING TEMP. (°C.) | ANNEALING TIME (HR) | FIELD (A/m) |
|---|---|---|---|
| A | 460 | 1 | N |
| B | 460 | 1 | T |
| C | 460 | 1 | L (800) |
| D | 460 | 2 | N |
| E | 460 | 2 | T |
| F | 460 | 2 | L (800) |
| G | 475 | 1 | N |
| H | 475 | 1 | T |
| I | 475 | 1 | L (1600) |

N = No field
T = Transverse field (80 kA/m, 1 kOe, provided by two Alnico magnets)
L = Longitudinal field (magnitudes in A/m)

Each sample core was placed in an oven. The oven was heated to the annealing temperature indicated in Table 1 in one hour. The core was annealed for the period of time indicated in Table 1. The anneals were conducted in an $N_2$ atmosphere. Magnetic fields, were applied, were applied throughout the entire anneal.

At the end of each anneal the alloys were cooled to room temperature in approximately 2 hours.

The core loss and coercivity of each sample are listed in Table 2.

TABLE 2

| SAMPLE | DC COERCIVE FIELD (A/m) | CORE LOSS (W/kg) 50kHz/0.1T |
|---|---|---|
| A | 2.4 | 9.3 |
| B | 2.8 | 8.7 |
| C | 2.4 | 13.2 |
| D | 2.4 | 10.8 |
| E | 3.6 | 10.6 |
| F | 4.0 | 13.0 |
| G | 4.0 | 14.2 |
| H | 4.8 | 9.3 |
| I | 10.8 | 12.6 |

Squareness ratios for the single annealed alloys range from 0.19 (Sample I, $B_{80}$ of 0.16T) to 0.46 (Sample C, $B_{80}$ of 0.83T, and Sample D, $B_{80}$ of 0.84T). $B_{80}$ is the magnetic induction measured at a drive field of 80 A/m.

The large jump in coercivity displayed by Sample I is attributable to the almost complete crystallization of the alloy (shown by FIG. 5, and discussed in greater detail below). It is believed that passing a large current through the windings around the core to produce a large magnetic field (1600 A/m) increased the core temperature above the set (475° C.) temperature and near or above the onset of the second crystallization temperature, resulting in substantially complete crystallization of the alloy.

Sample D (no field annealed at 460° C. for 2 hours) was analyzed using thermomagnetic analysis to determine the Curie temperatures of the alloy. Two Curie temperatures were observed at about 290° C. and about 400° C.

Sample D (no field annealed at 460° C. for 2 hours), and Sample I (annealed at 475° C. for 1 hour under the influence of a 1600 A/m (20 Oe) longitudinal field) were characterized via X-ray diffraction using CuK radiation. As-cast alloy was also examined.

Figure 2:
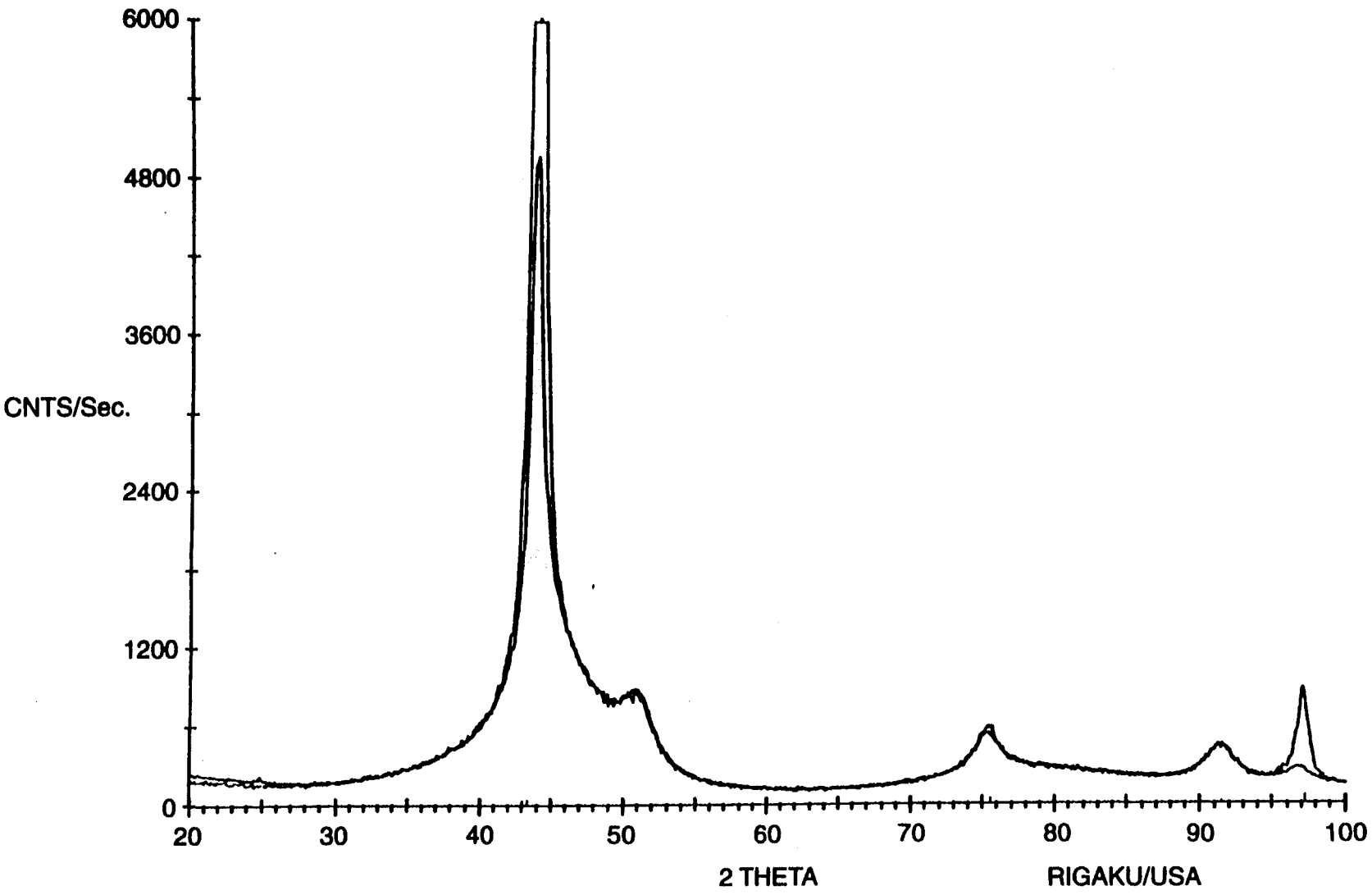
FIG. 2 is an X-ray diffraction pattern of an alloy which is cast and single annealed.
Figure 3:
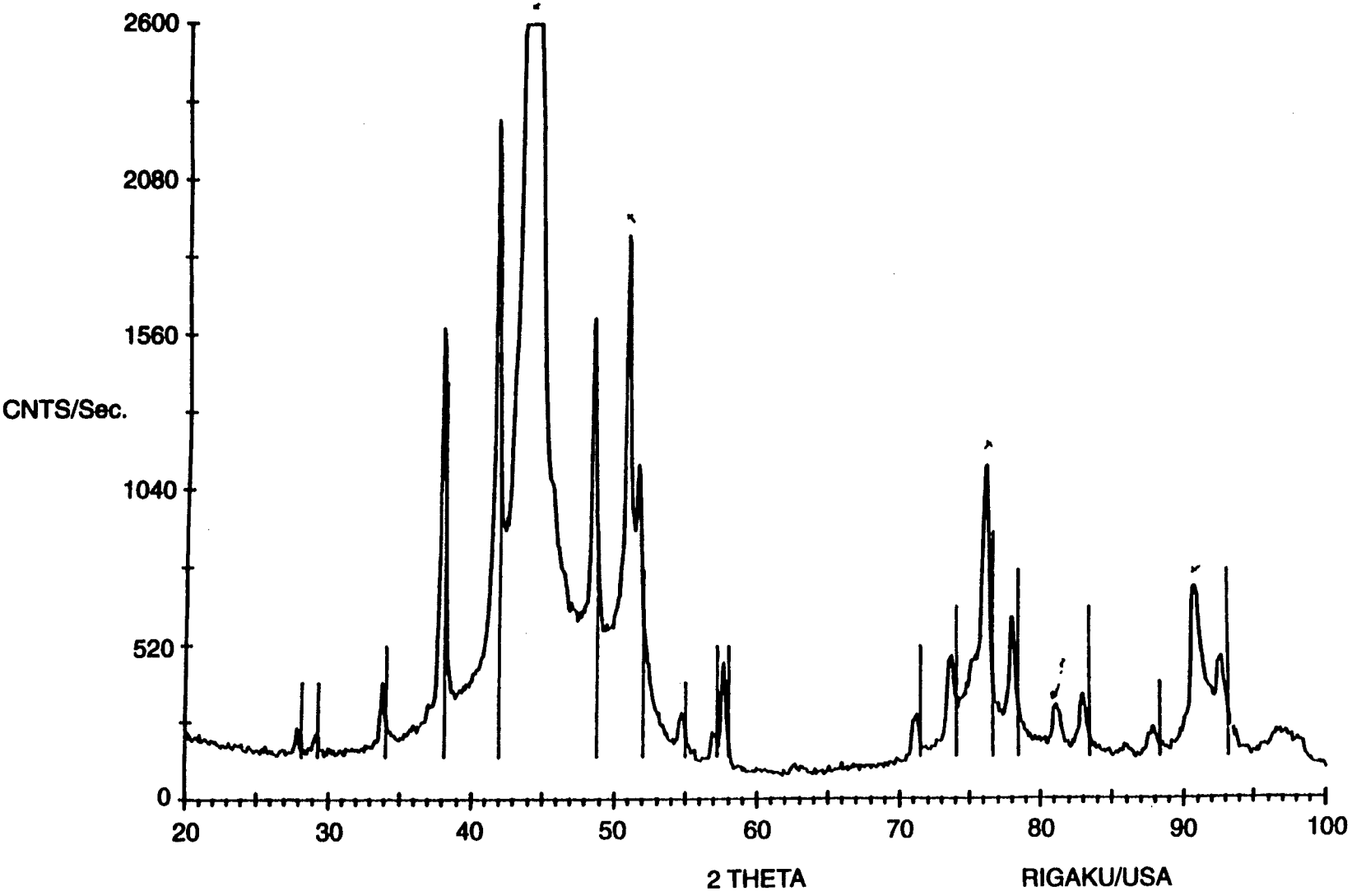
FIG. 3 is an X-ray diffraction pattern of an alloy which is annealed at conditions outside the scope of the present invention.

The as-cast alloy showed broad peaks, indicating an amorphous structure with no apparent crystalline structure (FIG. 1). Sample D showed a X-ray diffraction pattern having narrow peaks (FIG. 2) typical of a crystalline structure. The diffraction pattern shown by Sample D is typical of an fcc phase. The X-ray diffraction pattern of Sample J (FIG. 3) displayed additional peaks indicating the presence of other crystalline phases.

Micrographs of Samples D and I were taken using a Hitachi H-800 transmission electron microscope. The specimens were obtained by ion milling (5 keV, Ar beam at a 15° tilt angle) and a magnification of 90,000.

Figure 4:
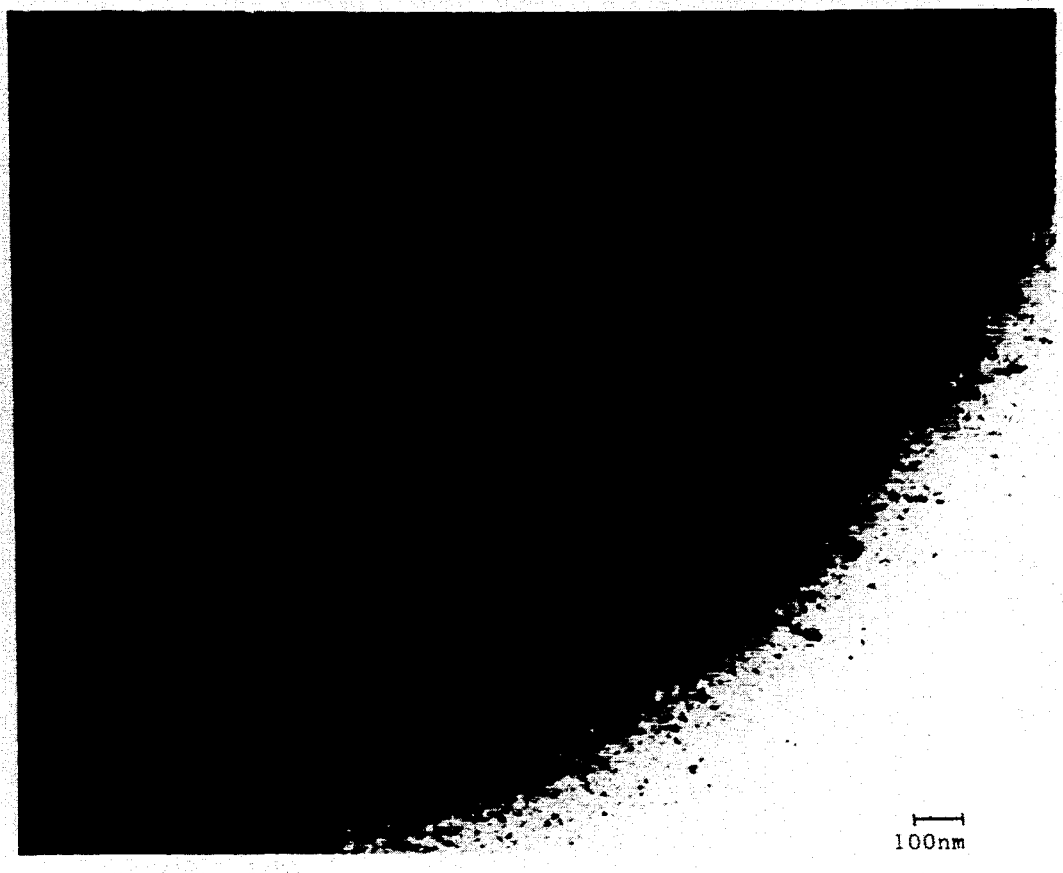
FIG. 4 is a TEM micrograph of the alloy whose diffraction pattern is shown in FIG. 2.

FIG. 4 is a micrograph obtained from a bulk sampling of Sample D. The micrograph shows fine crystalline particles measuring approximately 30 nm and less which are essentially uniformly distributed across the micrograph, indicating the nanocrystalline phase is essentially uniformly distributed throughout the alloy.

Figure 5:
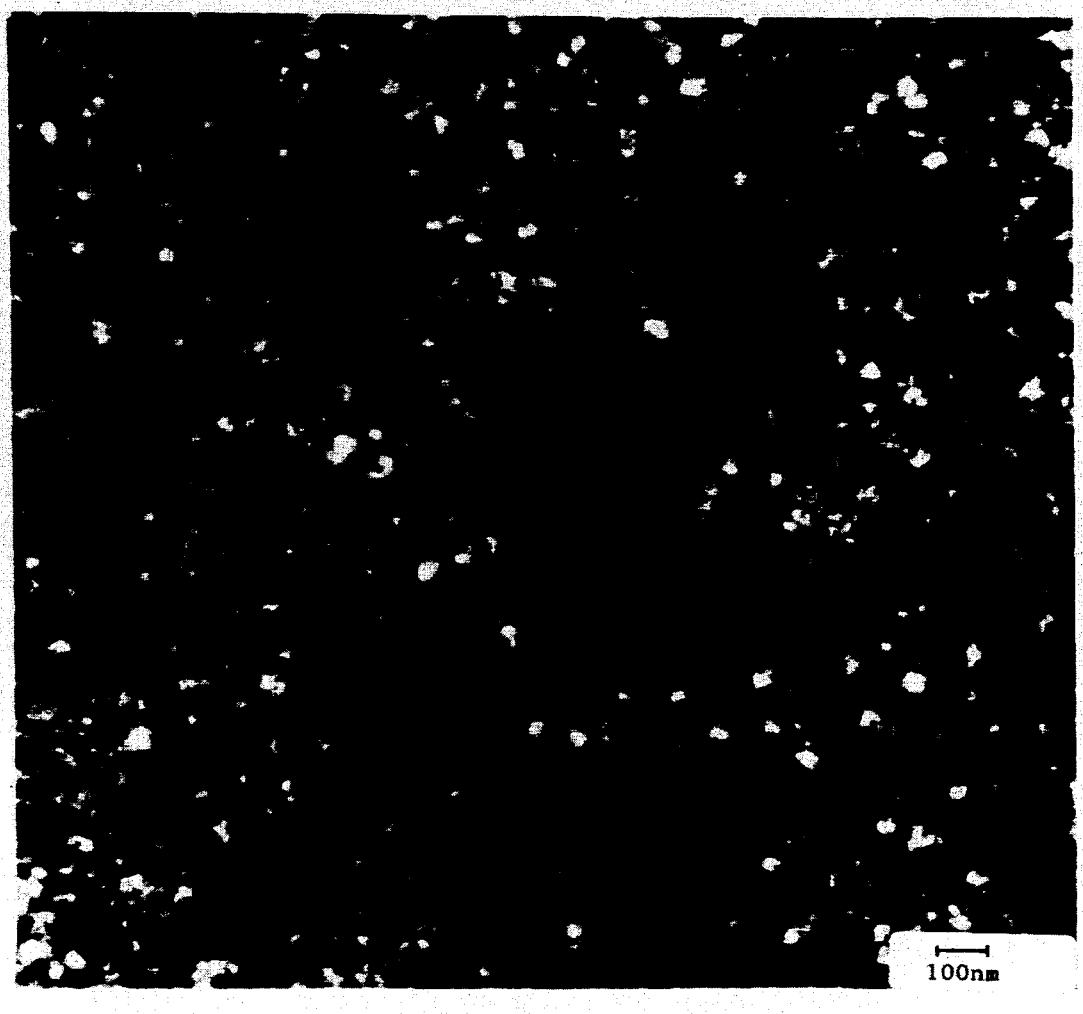
FIG. 5 is a TEM micrograph of the alloy whose diffraction pattern is shown in FIG. 3.

FIG. 5 is a micrograph obtained from a bulk sampling of Sample I. The micrograph, taken at the same magnification as FIG. 4, clearly shows larger crystals (60 nm and larger) distributed throughout the alloy.

Thus, annealed conducted between the onset of the first and second crystallization temperatures, under the influence of moderate magnetic fields, result in the formation of an essentially uniformly distributed nanocrystalline phase.

EXAMPLE 3

Cores made according to Example 1 were two step annealed under the following conditions:

TABLE 3

| SAMPLE | ANNEALING TEMP. (°C.) 1st/2nd | ANNEALING TIME (HR) 1st/2nd | FIELD (A/m) 1st/2nd |
|---|---|---|---|
| 1 | 460/380 | 1/1 | N/N |
| 2 | 460/380 | 1/1 | T/T |
| 3 | 460/380 | 1/1 | L/L (800) |
| 4 | 460/380 | 1/2 | N/N |
| 5 | 460/380 | 1/2 | T/T |
| 6 | 460/380 | 1/2 | L/L (800) |
| 7 | 460/370 | 1/1 | L/L (1600) |

N = No field
T = Transverse field (80 kA/m - 1 kOe - provided by two Alnico magnets)
L = Longitudinal field (magnitudes in A/m)

All anneals were conducted under an $N_2$ atmosphere. Magnetic fields were applied during the entire anneal, as indicated above.

Each sample was placed in an oven. The annealing temperature of 460° C. was reached after one hour. Each sample was kept at the annealing temperature for 1 hour, and then cooled for a half hour to the second annealing temperature. The temperature was maintained for the time indicated in Table 1, above, and thereafter was allowed to cool to room temperature over 2 hours.

The samples prepared according to the above described process display the following properties:

TABLE 4

| SAMPLE | DC COERCIVE FIELD (A/m) | CORE LOSS (W/kg) 50kHz/0.1T | CORE LOSS (W/kg) 50kHz/0.45T |
|---|---|---|---|
| 1 | 1.6 | 6.8 | 157 |
| 2 | 1.2 | 6.1 | 171 |
| 3 | 2.0 | 8.2 | 201 |
| 4 | 1.6 | 8.1 | 182 |
| 5 | 1.6 | 7.0 | 223 |
| 6 | 2.0 | 13.4 | 255 |
| 7 | 4.0 | 11.9 | 217 |

The core loss for each sample was measured at room temperature, 50 kHz and 0.1T, and 50 kHz and 0.45T. Squareness ratios for two step annealed alloys ranged from a low of 0.07 (Sample 5, $B_{80}$ of 0.84T) to high of 0.63 (Sample 7, $B_{80}$ of 0.86T).

Figure 6:
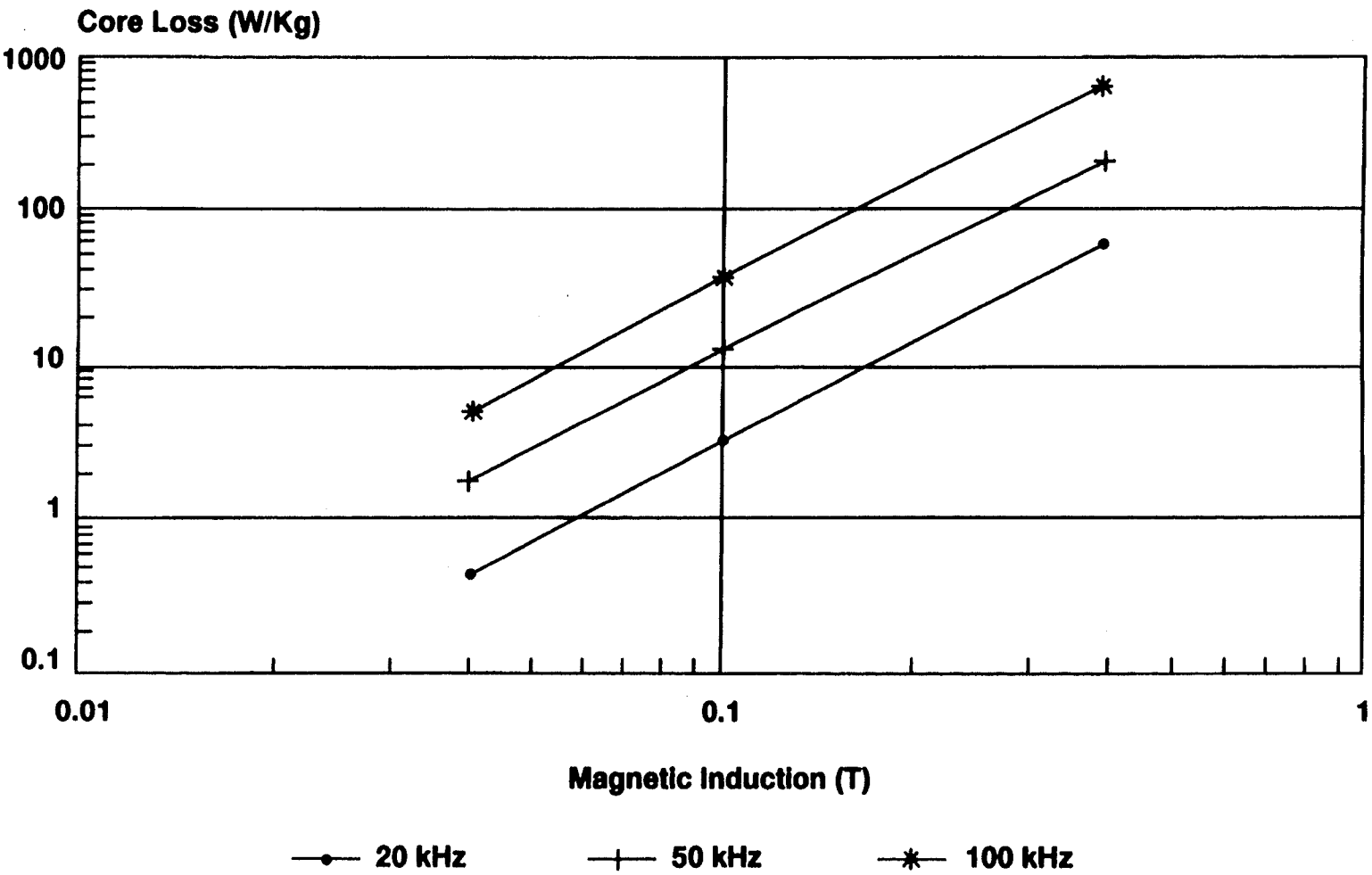
FIG. 6 is a log - log graph showing the effect at room temperature and three different frequencies, of increasing magnetic induction on the core loss of a no field annealed alloy of the present invention.

FIG. 6 shows the core loss of the no field annealed core (Sample 1). The core loss was measured at three different frequencies and magnetic inductions. All measurements were taken at room temperature.

Figure 7:
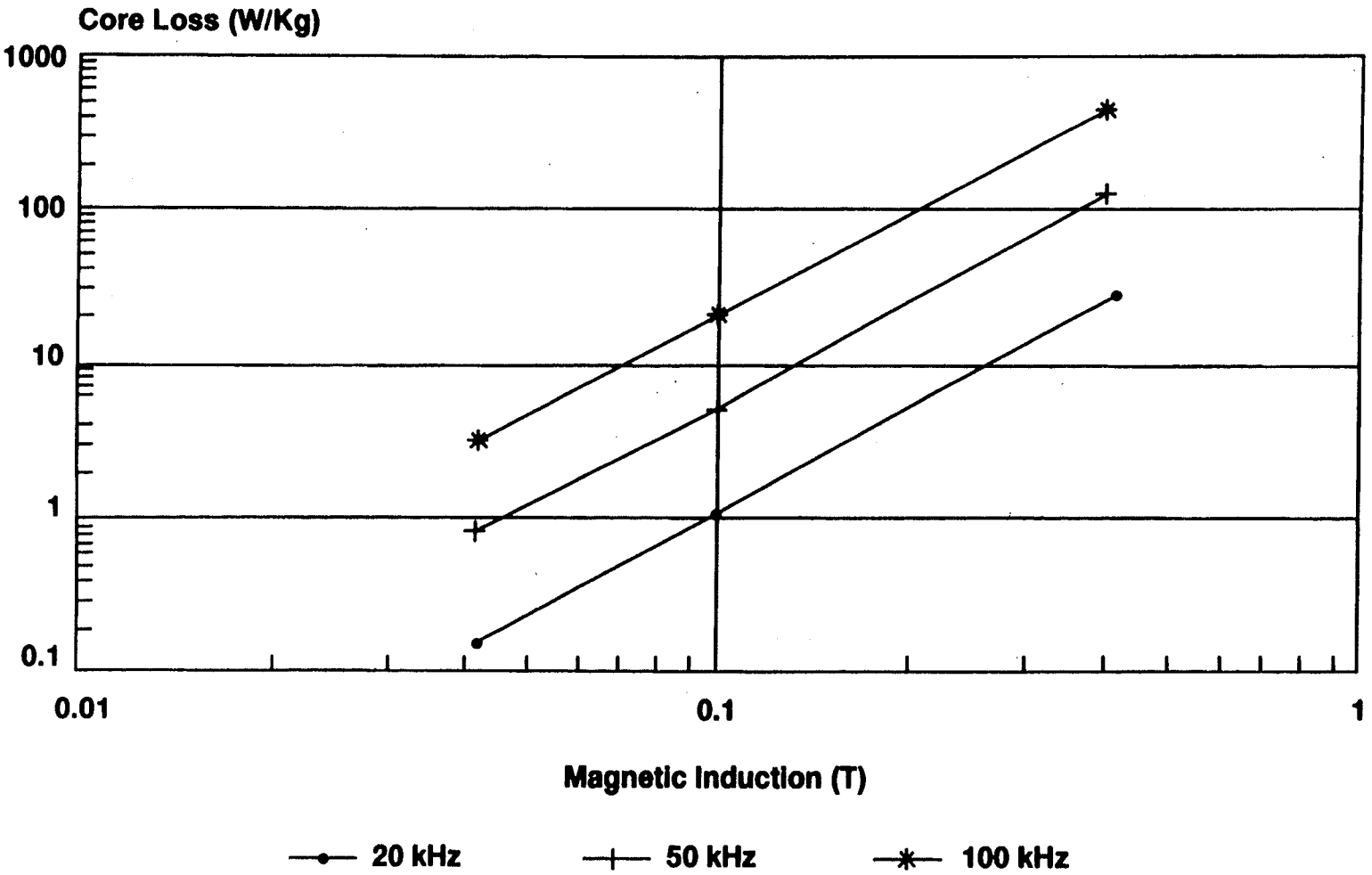
FIG. 7 is a log - log graph showing the effect, at room temperature and three different frequencies, of increasing magnetic induction on the core loss of an alloy annealed in a transverse field.

FIG. 7 shows the core loss of the same alloy annealed under the influence of an 80 kA/m (1 kOe) transverse field (Sample 2). As in FIG. 6, the core loss of the alloy was measured at three different frequencies and magnetic inductions. The core losses displayed by the transverse field annealed alloy (charted in FIG. 7) are much lower than those shown displayed by the same alloy which was annealed without any magnetic field influence during the second annealing step.

Figure 8:
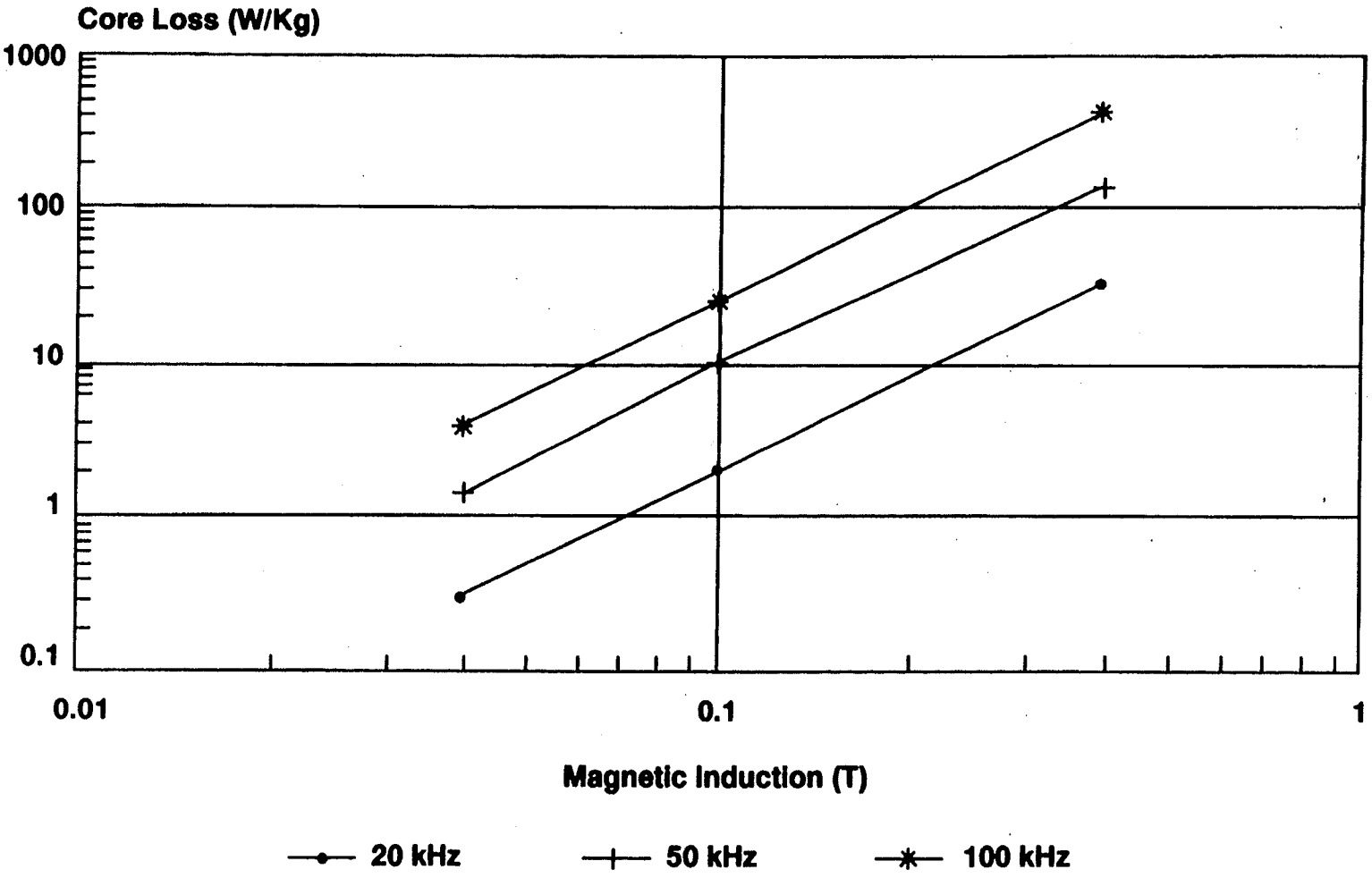
FIG. 8 is a log - log graph showing the effect of increasing magnetic induction, at room temperature and three different frequencies, on the core loss of an alloy annealed in a longitudinal field.

FIG. 8 shows the relationship between core loss, frequency and induction for the core which was second annealed in a 800 A/m (10 Oe) longitudinal field (Sample 3).

Figure 9:
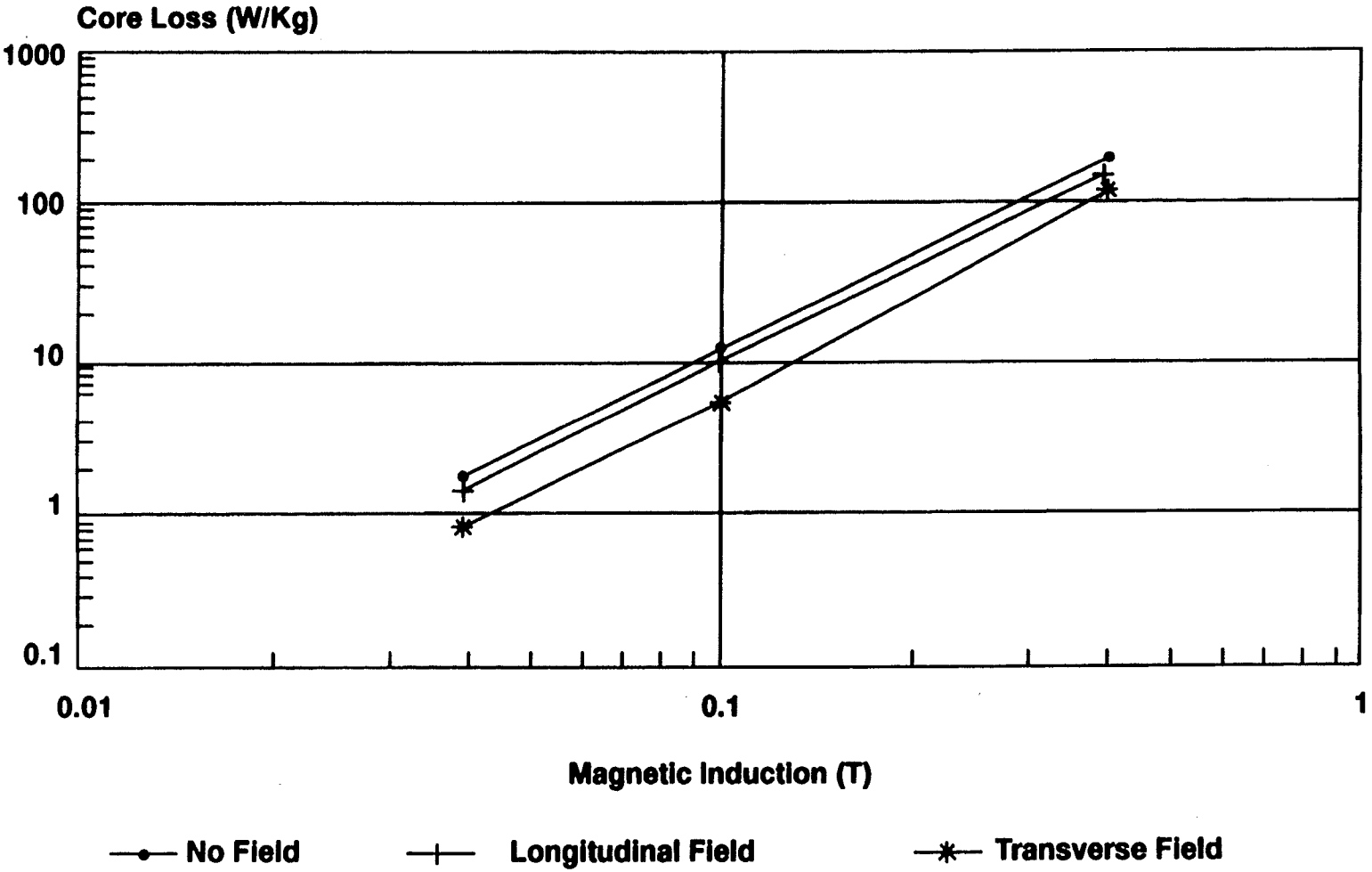
FIG. 9 is a log - log graph which compares the effect of increasing magnetic induction at 50 kHz and room temperature, on the core losses of alloys annealed in longitudinal, transverse and no field.

FIGS. 9 compares the core losses of Samples 1–3 at 50 kHz against each other. Alloys which are annealed under a transverse field display the lowest core losses of the alloys of the present invention.

EXAMPLE 4

Cores prepared as in Example 1 were dual step annealed under the conditions listed in Table 5.

TABLE 5

| SAMPLE | ANNEALING TEMP. (°C.) 1st/2nd | ANEALING TIME (HR) 1st/2nd | FIELD (A/m) |
|---|---|---|---|
| 11 | 460/240 | 1/2 | L (800 Oe) |
| 12 | 460/240 | 1/2 | L (1600 Oe) |

The conditions for the first step of the anneal are identical to those of Example 3. However, the second step of the anneal is carried out just below the Curie temperature of the second magnetic phase for two hours. The magnetic field was applied throughout both steps of the anneal. Magnetic characteristics of Samples 11 and 12 are listed in Table 6 below.

TABLE 6

| SAMPLE | CORE LOSS (W/kg) 50KHz/0.1T | $B_{80}$ (T) | SQUARENESS RATIO $B_r/B_{80}$ |
|---|---|---|---|
| 11 | 18 | 0.94 | 0.72 |
| 12 | 18 | 0.89 | 0.72 |

Annealing under these conditions yields a nanocrystalline alloy which displays improved squareness over the alloys prepared according to Example 3 (high of 0.63), and single annealed alloys, such as those prepared in Example 2 (high of 0.46).

EXAMPLE 5

An alloy with the composition $Fe_{39.6}Ni_{37.6}Mo_4Cu_1B_{17.8}$ was melted and cast as in Example 1. The resulting ribbon was wound into toroidal cores having the same mass, and inner and outer diameters as the cores of examples 1 through 4. Cores of the alloy containing copper were single annealed as in Example 2, to determine the Curie temperatures, which are about 300° C. (for the second magnetic phase) and 380° C. (for the nanocrystalline phase). The alloys containing copper were two step annealed under the conditions listed in Table 7, below.

TABLE 7

| SAMPLE | ANNEALING TEMP. (°C.) 1st/2nd | ANEALING TIME (HR) 1st/2nd | FIELD (A/m) 1st/2nd |
|---|---|---|---|
| 5 | 460/360 | 1/1 | N/N |
| 6 | 460/360 | 1/1 | T/T |
| 7 | 460/360 | 1/1 | L/L (1600) |

N = No field
T = Transverse field (80,000 A/m - 1 kOe - provided by two Alnico magnets)
L = Longitudinal field (magnitudes in A/m)

The annealing conditions for Samples 15 and 16 are identical to those of Example 2, Samples 1, 2. Sample 17 is second step annealed 10° C. lower than Sample 7 of Example 2. All other annealing conditions were identical.

The coercivities and core losses of the copper alloy core are listed below, in Table 8.

TABLE 8

| SAMPLE | DC COERCIVE FIELD (A/m) | CORE LOSS (W/kg) 50kHz/0.1T | CORE LOSS (W/kg) 50kHz/0.45T |
|---|---|---|---|
| 15 | 2.8 | 10.1 | 242 |
| 16 | 3.2 | 7.7 | 174 |
| 17 | 5.2 | 7.2 | 160 |

Accordingly, comparing alloys of Example 5 with those of Example 3, it is clear that magnetic properties of alloy are not improved by the addition of copper.

What is claimed is:

1. A metallic alloy having nanocrystalline particles distributed in a matrix, the alloy consisting of:
   about 6 to about 72 atomic % Fe;
   about 12 to about 81 atomic % Ni; where the sum of the atomic percentages of Fe and Ni is about 60 to about 90%;
   about 0 1 to about 10 atomic % of at least one element selected from a group consisting of Cr, Mo, W, Nb, Ta, Ti, Zr and Hf;
   about 0.1 to about 30 atomic percent B;
   0 to about 15 atomic % Si; where the sum of the atomic % of B and Si is about 0.1 to about 30 atomic %;
   where the sum of the above elements plus impurities is 100; and
   said nanocrystalline particles have an effective particle size no larger than about 100 nm.

2. The alloy of claim 1 wherein said at least one element is Mo.

3. A metallic alloy having nanocrystalline particles distributed in a matrix, the alloy consisting of:
   about 7 to about 69.6 atomic % Fe;
   about 14 to about 78.3 atomic % Ni; where the sum of the atomic percentages of Fe and Ni is about 70 to about 87%;
   about 1.0 to about 8 atomic % Mo;
   about 13 to about 22 atomic % B;
   about 0 to about 10 atomic % Si;
   where the sum of the atomic % of B and Si is about 13 to about 30 atomic %, and the sum of the atomic % of the above elements, plus impurities is 100; and said nanocrystalline particles have an effective particle size no larger than about 100 nm.

4. A metallic alloy having nanocrystalline particles distributed in a matrix, the alloy consisting of:
   about 7 to about 45.2 atomic % Fe;

about 33.6 to about 72 atomic % Ni; where the sum of the atomic percentages of Fe and Ni is about 70 to about 87 atomic %;

about 2 to about 6 atomic % Mo;

about 14 to about 18 atomic percent B;

0 to about 5 atomic percent Si; where the sum of the atomic % of B and Si is about 14 to about 30 atomic %;

where the sum of the atomic % of the above elements, plus impurities is 100; and said nanocrystalline particles have an effective particle size no larger than about 100 nm in diameter.

5. The alloy of claim 4 having the nominal composition $Fe_{40}Ni_{38}Mo_4B_{18}$.

6. The alloy of claim 1 whose structure is at least about 20% nanocrystalline.

7. The alloy of claim 1 wherein said nanocrystalline particles have an effective particle size of less than 30 nm.

8. The alloy of claim 1 wherein said nanocrystalline particles have an effective particle size of less than 10 nm.

9. The alloy of claim 1 having nanocrystalline particles essentially uniformly distributed in an amorphous matrix.

10. A metallic alloy having nanocrystalline particles distributed in a matrix, the alloy comprising:

about 6 to about 72 atomic % Fe;

about 12 to about 81 atomic % Ni; where the sum of the atomic percentages of Fe and Ni is about 60 to about 90%;

about 0.1 to about 10 atomic % Mo;

about 0.1 to about 30 atomic percent B;

0 to about 15 atomic % Si; where the sum of the atomic % of B and Si is about 0.1 to about 30 atomic %;

where the sum of all the elements plus impurities is essentially 100;

said nanocrystalline particles have an effective particle size no larger than about 100 nm and are made up of FeNiMo having a fcc structure.

11. A metallic alloy having nanocrystalline particles distributed in a matrix, the alloy comprising:

about 6 to about 72 atomic % Fe;

about 12 to about 81 atomic % Ni: where the sum of the atomic percentages of Fe and Ni is about 60 to about 90%;

about 0.1 to about 10 atomic % of at least one element selected from a group consisting of Cr, Mo, W, Nb, Ta, Ti, Zr, V and Hf;

about 0.1 to about 30 atomic % B;

0 to about 15 atomic % Si; where the sum of the atomic % of B and Si is about 0.1 to about 30 atomic %;

said alloy being essentially free of Cu; and said nanocrystalline particles have an effective particle size no larger than about 100 nm.

* * * * *